US012078466B2

(12) United States Patent
Rivoal et al.

(10) Patent No.: US 12,078,466 B2
(45) Date of Patent: Sep. 3, 2024

(54) AVALANCHE TRIGGERING SYSTEM

(71) Applicant: MND France, Sainte-Helene-du-Lac (FR)

(72) Inventors: Olivier Rivoal, Barberaz (FR); Stéphane Constant, Saint Pierre D'Allevard (FR); Jean-Marc Neuville, Sassenage (FR); Louis Noel, Cusy (FR); Pierre Fleur, Saint Vincent de Mercuze (FR); François-Xavier Villalonga, Aix-les-Bains (FR); Vincent Costecalde, Saint Maximin (FR)

(73) Assignee: MND FRANCE, Sainte-Helene-du-Lac (FR)

( * ) Notice: Subject to any disclaimer, the term of this patent is extended or adjusted under 35 U.S.C. 154(b) by 0 days.

(21) Appl. No.: 17/767,780

(22) PCT Filed: Oct. 8, 2020

(86) PCT No.: PCT/FR2020/051772
§ 371 (c)(1),
(2) Date: Apr. 8, 2022

(87) PCT Pub. No.: WO2021/069839
PCT Pub. Date: Apr. 15, 2021

(65) Prior Publication Data

US 2024/0085163 A1 Mar. 14, 2024

(30) Foreign Application Priority Data

Oct. 10, 2019 (FR) ..... 19/11258

(51) Int. Cl.
*F42D 3/00* (2006.01)
*E01F 7/04* (2006.01)
*F42D 1/00* (2006.01)

(52) U.S. Cl.
CPC ..... *F42D 3/00* (2013.01); *E01F 7/04* (2013.01); *F42D 1/00* (2013.01)

(58) Field of Classification Search
CPC ..... F42D 1/00; F42D 3/00; F42D 3/02; F42D 3/04; F42D 3/06; F42D 99/00; E01F 7/00; E01F 7/04
(Continued)

(56) References Cited

U.S. PATENT DOCUMENTS 5,107,765 A 4/1992 Schippers
6,279,481 B1 * 8/2001 Schippers ..... F42D 3/00 102/302
6,324,982 B1 12/2001 Eubert-Berard et al.
6,584,773 B2 7/2003 Ledys et al.
(Continued)

FOREIGN PATENT DOCUMENTS

FR 2636729 A1 3/1990
FR 2771168 A1 5/1999
(Continued)

OTHER PUBLICATIONS

English Summary of Office Action dated Apr. 27, 2023; Georgian Application No. AP 2020 15939; 1 page.
(Continued)

*Primary Examiner* — James S Bergin
(74) *Attorney, Agent, or Firm* — CANTOR COLBURN LLP

(57) ABSTRACT

This avalanche triggering system includes a portable unit configured to be carried by an operator, the portable unit comprising a gas storage device configured to store an oxidizing gas and a combustible gas; an explosion unit which is configured to be launched by the operator or to be transported by a drone and which includes a flexible envelope configured to be filled with an explosive gas mixture, the flexible envelope being deformable between a rest configuration in which the flexible envelope has a first inner
(Continued)

volume and an inflated configuration in which the flexible envelope has a second inner volume which is greater than the first inner volume, the explosion unit further including an ignition device configured to trigger the explosion of the explosive gas mixture contained in the flexible envelope; and a control unit configured to remotely control the ignition device.

20 Claims, 2 Drawing Sheets

(58) Field of Classification Search
USPC ..... 102/301
See application file for complete search history.

(56) References Cited

U.S. PATENT DOCUMENTS

| | | | | |
|---|---|---|---|---|
| 7,707,938 | B2 * | 5/2010 | Hisel | F42B 12/52 102/302 |
| 8,342,096 | B2 * | 1/2013 | Greipl | F42D 3/00 102/302 |
| 8,430,032 | B2 * | 4/2013 | Farizy | F42D 3/00 102/302 |
| 8,904,939 | B2 * | 12/2014 | Constant | F42D 3/00 102/302 |
| 8,960,092 | B2 * | 2/2015 | Farizy | F42D 3/00 102/302 |
| 10,968,579 | B2 * | 4/2021 | Brophy | F42C 19/0807 |

FOREIGN PATENT DOCUMENTS

| | | | |
|---|---|---|---|
| FR | 2811420 | A1 | 1/2002 |
| FR | 2964732 | A1 | 3/2012 |
| GB | 2199289 | A | 7/1988 |
| RU | 2107889 | C1 | 3/1998 |
| RU | 2284389 | C2 | 9/2006 |
| WO | 8908234 | A1 | 9/1989 |
| WO | 2009049345 | A1 | 4/2009 |

OTHER PUBLICATIONS

Office Action dated Apr. 27, 2023; Georgian Application No. AP 2020 15939; 5 pages (non-English).

International Search Report for International Application No. PCT/FR2020/051772; Date of Completion: Dec. 16, 2020; Date of Mailing: Jan. 12, 2021; 4 Pages.

Translation of International Search Report for International Application No. PCT/FR2020/051772; Date of Completion: Dec. 16, 2020; Date of Mailing: Jan. 12, 2021; 2 Pages.

Written Opinion for International Application No. PCT/FR2020/051772; International Filing Date: Oct. 8, 2020; Date of Mailing: Jan. 12, 2021; 5 Pages.

Russian Office Action for corresponding RU Application No. 2022110568/03(022271); Issue Date, Jan. 16, 2024.

Russian Search Report for corresponding RU Application No. 2022110568/03(022271); Issue Date, Jan. 16, 2024.

* cited by examiner

AVALANCHE TRIGGERING SYSTEM

CROSS REFERENCE TO RELATED APPLICATIONS

This application is a National Stage of PCT Application No. PCT/FR2020/051772 filed on Oct. 8, 2020, which claims priority to French Patent Application No. 19/11258 filed on Oct. 10, 2019, the contents each of which are incorporated herein by reference thereto.

TECHNICAL FIELD

The present invention concerns the field of the avalanche preventive triggering and more particularly relates to an avalanche triggering system.

BACKGROUND

The avalanche preventive triggering mainly aims at securing ski areas, traffic networks, or even dwellings.

The snowpack that forms on the slope of a wall comprises a set of snow layers deposited on top of each other according to the snowfall. These different layers are often made up of different types of snow, resulting in some level of heterogeneity of the snowpack, often giving rise to the avalanche.

The avalanche preventive triggering consists in causing a shock wave on an upper area of the surface of the snowpack so as to cause a disruption of the balance of the snowpack in this area, and this before the accumulation of snow may cause a destructive natural avalanche.

Systems and techniques for intentionally triggering avalanches are already known.

A first known technique consists in placing explosive charges by an operator at the precise location where the avalanche is to be triggered. This placement may be done either from a helicopter by launching, or from the ground, the explosive charge may then be deposited, slid or launched at the appropriate location. The ignition of the charge, in both cases, is generally obtained electrically or by slow fuse. The risks inherent in this technique are significant. In addition to the risks directly related to the handling of explosives, the operator must, for the placement of explosive charges intervening directly on the ground, go to often steep areas where the snowpack is unstable.

In order to reduce these risks related to the displacement of an operator on the firing area, remote triggering techniques have been put in place. Remote triggering techniques use military weapons such as rocket launchers or explosive shell launchers to cause the explosion on site. This type of device is not suitable for certain legislation, such as French legislation, which prohibits the storage of primed charges.

One way to reduce the risks related to the handling of the explosives is to use explosive gases to generate a shock wave to trigger the avalanche.

FR2636729 describes a remote avalanche triggering system which operates without explosive material and which is known under the trademark Gazex®. Such a system includes a barrel mounted on a concrete support and comprising an opening oriented towards the surface of the snowpack, a filling circuit configured to fill the barrel with an explosive gas mixture, and an ignition device which is configured to trigger the explosion of the explosive gas mixture.

This type of avalanche triggering system comprises a reserve of gas sufficient for one season which is installed in an adjacent technical room, and an ignition device which is controlled remotely. Thus, this type of avalanche triggering system has a complete autonomy and offers perfect safety for the operator. The fixed installation of this system also makes it possible to guarantee sufficient, reproducible and durable power for the protection of large avalanche paths.

The main drawbacks related to this type of system are the need to carry out a heavy installation requiring a major civil engineering operation for the system itself, the adjacent technical room and the connecting pipes connecting them and the need to carry out its maintenance on the installation site which is, by definition, difficult to access. The present invention aims at overcoming these drawbacks.

BRIEF SUMMARY

The present invention aims at overcoming all or part of these drawbacks.

The technical problem underlying the invention consists therefore at providing an avalanche triggering system which is simple and economical in structure, while limiting the risk of injury to an operator.

To this end, the present invention concerns an avalanche triggering system including:

- a portable unit configured to be carried by an operator, the portable unit comprising a gas storage device configured to store an oxidizing gas and a combustible gas,
- an explosion unit which is configured to be launched by the operator and which is fluidly connected to the portable unit, the explosion unit including a flexible envelope which is configured to be at least partially filled with an explosive gas mixture formed by combustible gas and oxidizing gas coming from the gas storage device, the flexible envelope being deformable between a rest configuration in which the flexible envelope has a first inner volume and an inflated configuration in which the flexible envelope has a second inner volume which is greater than the first inner volume and is at least partially filled with the explosive gas mixture, the explosion unit further including an ignition device which is configured to trigger the explosion of the explosive gas mixture contained in the flexible envelope, and
- a control unit which is configured to remotely control the ignition device.

Such a configuration of the avalanche triggering system allows the latter to be transported by an operator and therefore does not require the performance of civil engineering operation for the installation on site of the avalanche triggering system, which substantially reduces the costs of using the avalanche triggering system, as well as the visual nuisance on the operation site.

In addition, such a configuration of the avalanche triggering system substantially limits the risks of injuries to the operator, since on the one hand he does not have to handle explosive charges, and on the other hand the triggering of the ignition device may be carried out remotely using the control unit.

Consequently, the avalanche triggering system according to the present invention has a simple and economical structure, while considerably limiting the risks of injuries to an operator.

The avalanche triggering system may additionally have one or more of the following features, considered alone or in combination.

According to an embodiment of the invention, the flexible envelope includes an envelope chamber configured to contain the explosive gas mixture, and a filling opening which opens into the envelope chamber.

According to an embodiment of the invention, the flexible envelope is inflatable.

According to an embodiment of the invention, the gas storage device includes an oxidizing gas tank and a combustible gas tank.

According to an embodiment of the invention, the oxidizing gas tank and the combustible gas tank are removable.

According to an embodiment of the invention, the portable unit includes a combustible gas distribution circuit which is fluidly connected to the combustible gas tank, and an oxidizing gas distribution circuit which is fluidly connected to the oxidizing gas tank.

According to an embodiment of the invention, the combustible gas distribution circuit successively includes a first pressure regulator, a first solenoid valve and a first non-return valve, and the oxidizing gas distribution circuit successively includes a second pressure regulator, a second solenoid valve and a non-return valve.

According to an embodiment of the invention, the avalanche triggering system includes a combustible gas supply conduit which extends between the portable unit and the explosion unit and which is configured to fluidly connect the combustible gas distribution circuit to the flexible envelope, and an oxidizing gas supply conduit which extends between the portable unit and the explosion unit and which is configured to fluidly connect the oxidizing gas distribution circuit to the flexible envelope.

According to an embodiment of the invention, the portable unit includes a first connection fitting which is configured to be fluidly connected to the combustible gas tank, and a second connection fitting which is configured to be fluidly connected to the oxidizing gas tank, and the explosion unit includes a primary connection fitting which is configured to be fluidly connected to the flexible envelope, and a secondary connection fitting which is configured to be fluidly connected to the flexible envelope, the combustible gas supply fluidly conduit connecting the first connection fitting to the primary connection fitting, and the oxidizing gas supply conduit fluidly connecting the second connection fitting to the secondary connection fitting.

According to an embodiment of the invention, the avalanche triggering system further includes a safety device which is configured to prevent an ignition of the ignition device if a separation distance separating the explosion unit from the portable unit is less than a predetermined value.

According to an embodiment of the invention, the safety device includes a transmitter which is carried by one of the portable unit and the explosion unit, a receiver which is carried by the other of the portable unit and the explosion unit and which is configured to communicate with the transmitter, the safety device being configured to calculate the separation distance separating the transmitter from the receiver and to prevent ignition of the ignition device if the separation distance is less than the predetermined distance.

According to an embodiment of the invention, the safety device includes a processing unit which is configured to calculate the separation distance separating the transmitter from the receiver, the processing unit being configured to prevent ignition of the ignition device if the separation distance is less than the predetermined distance. The processing unit of the safety device may for example be formed by the control unit.

According to an embodiment of the invention, the safety device is a wireless measurement system of the ARVA, GPS or IOT type. The measurement system is for example configured to measure the distance between the flexible envelope and the control unit.

According to an embodiment of the invention, the control unit is carried by the portable unit.

According to an embodiment of the invention, the portable unit includes a control panel.

According to an embodiment of the invention, the portable unit includes an electrical energy storage device, such as a rechargeable battery, configured to electrically power the portable unit and the ignition device.

According to an embodiment of the invention, the avalanche triggering system includes a power supply cable which electrically connects the ignition device to the portable unit.

According to an embodiment of the invention, the avalanche triggering system includes a connecting cable which extends between the portable unit and the explosion unit and which contains the combustible gas supply conduit, the oxidizing gas supply conduit and the power supply cable.

According to an embodiment of the invention, the explosion unit includes combustible dust which is configured to be received in the flexible envelope. The combustible dust may for example include dust of agricultural origin, such as starch dust, peanut dust, wood dust, cellulose dust, flour, cornstarch and sugar dust, metal dust, such as aluminum or magnesium dust, chemical dust, such as acetylsalicylic acid dust, ascorbic acid dust and dust of 2,6-Di-tert-butylphenol, mineral dust, such as coal or talc dust, or plastic and rubber dust, such as polyacrylonitrile dust, polycarbonate dust, polyester dust, polyethylene dust, polypropylene dust, polystyrene dust and polyurethane dust.

According to an embodiment of the invention, the explosion unit includes an inner housing containing the combustible dust, the explosion unit being configured such that the combustible dust is projected into the flexible envelope by the oxidizing gas and the combustible gas coming from the gas storage device when the flexible envelope is at least partially filled with the explosive gas mixture.

According to an embodiment of the invention, the explosion unit includes a removable cartridge including a receiving housing in which the flexible envelope is housed.

According to an embodiment of the invention, the explosion unit comprises a support portion which includes the ignition device, the removable cartridge being removably mounted on the support portion.

According to an embodiment of the invention, the explosion unit includes a gripping handle. The gripping handle is preferably provided on the support portion.

According to an embodiment of the invention, the removable cartridge includes a cartridge casing and a removable protective cover which at least partially delimit the receiving housing, the protective cover being configured to be ejected from the cartridge casing by the flexible envelope when the flexible envelope is deformed into the inflated configuration.

According to an embodiment of the invention, the flexible envelope is configured to extend at least partly outside the receiving housing when the flexible envelope is in the inflated configuration.

According to an embodiment of the invention, the removable cartridge includes the inner housing containing the combustible dust.

According to an embodiment of the invention, the removable cartridge includes a frangible separation wall which separates the receiving housing from the inner housing, the frangible separation wall being configured to be ruptured when the explosion unit is supplied with oxidizing gas and combustible gas coming from the gas storage device and the flexible envelope being configured to be fluidly connected to the inner housing when the frangible separation wall is ruptured so as to allow the combustible dust to be projected into the flexible envelope. Advantageously, the frangible separation wall is formed by a frangible separation membrane.

According to an embodiment of the invention, the frangible separation wall is configured to be ruptured when the pressure in the inner housing exceeds a predetermined pressure value.

According to an embodiment of the invention, the removable cartridge includes a dust storage portion delimiting the inner housing, the dust storage portion including a first tubular end portion which is closed off by the frangible separation wall and which is at least partially inserted into the flexible envelope, and a second tubular end portion which is opposite to the first tubular end portion and which is closed off by a frangible closure wall.

According to an embodiment of the invention, the explosion unit includes an inner chamber which is partially delimited by the frangible closure wall, the explosion unit further including a combustible gas supply circuit which opens into the inner chamber and which is configured to be connected to the combustible gas tank, and an oxidizing gas supply circuit which opens into the inner chamber and which is configured to be connected to the oxidizing gas tank.

According to an embodiment of the invention, the frangible closure wall is configured to be ruptured when the explosion unit is supplied with oxidizing gas and combustible gas coming from the gas storage device. Advantageously, the frangible closure wall is configured to be ruptured when the pressure in the inner chamber exceeds a predetermined pressure.

According to an embodiment of the invention, the oxidizing gas is dioxygen, ozone, hydrogen peroxide, halogens, or any other oxidizing gas.

According to an embodiment of the invention, the combustible gas is dihydrogen, methane, ethane, propane, butane, pentane, acetylene, or any other combustible gas.

According to an embodiment of the invention, the ignition device includes a spark plug. Advantageously, the spark plug is configured to generate a spark adapted to cause ignition of the explosive gas mixture.

According to another embodiment of the invention, the ignition device includes an electric detonator, a slow fuse, a NONEL® type detonator, a device for generating an open flame, a glow plug or any other device allowing the explosion of the explosive gas mixture, and in particular the heating of the explosive gas mixture above a predetermined temperature, for example above 450° C.

According to an embodiment of the invention, the explosion unit is configured to be transported by a drone.

According to an embodiment of the invention, the explosion unit includes a fastening member configured to removably fasten the explosion unit to a drone.

BRIEF DESCRIPTION OF THE DRAWINGS

Anyway, the invention will be better understood from the following description with reference to the appended schematic drawings representing, as a non-limiting example, an embodiment of this avalanche triggering system.

DETAILED DESCRIPTION

Figure 1:
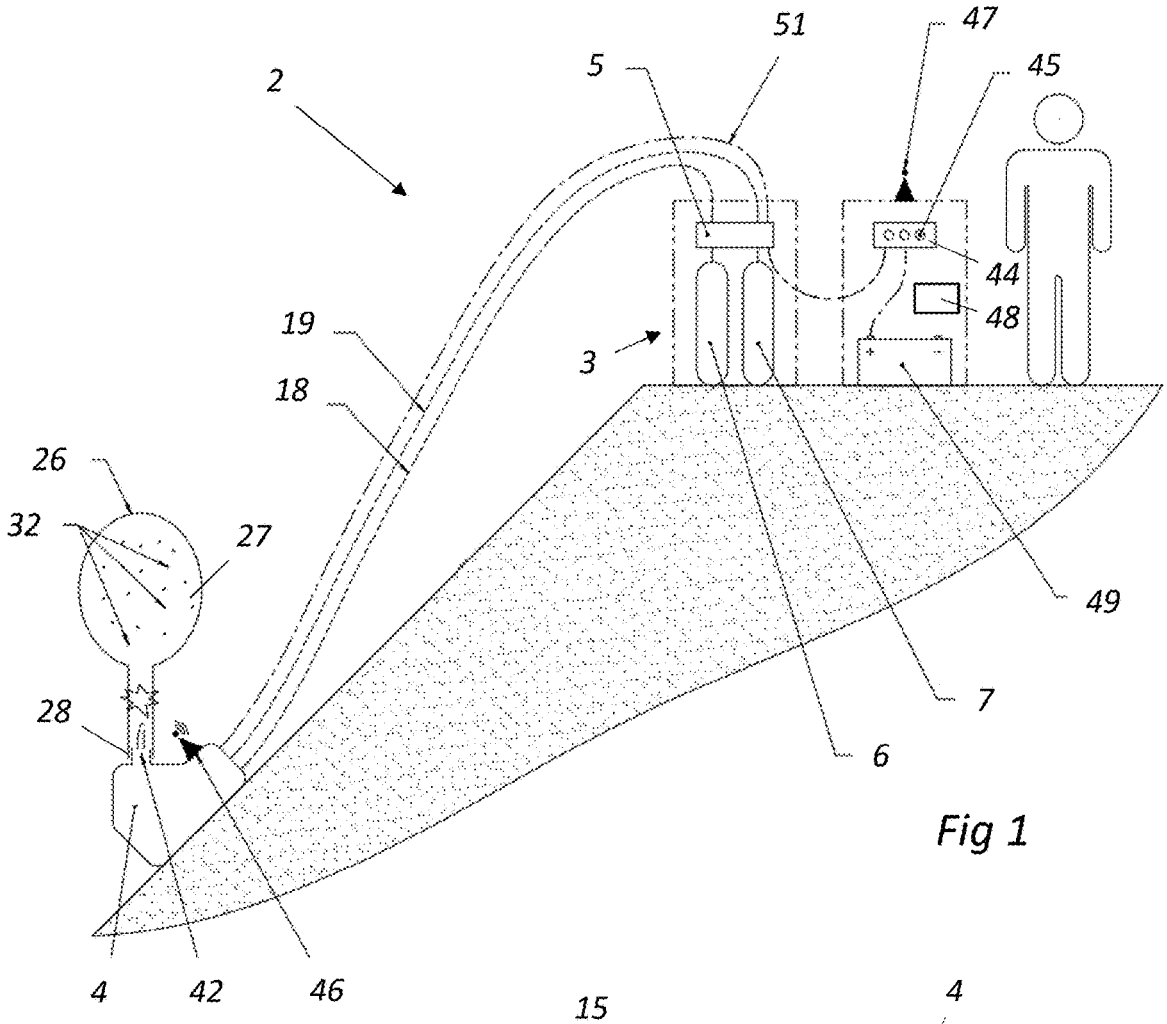
FIG. 1 is a schematic view of an avalanche triggering system according to the present invention.

FIGS. 1 to 4 represent an avalanche triggering system 2 including a portable unit 3 configured to be carried by an operator and an explosion unit 4 configured to be launched by the operator.

The portable unit 3 comprises a gas storage device 5 configured to store an oxidizing gas and a combustible gas. More particularly, the gas storage device includes an oxidizing gas tank 6, such as an oxidizing gas bottle, and a combustible gas tank 7, such as a combustible gas bottle. Advantageously, the combustible gas tank 6 and the oxidizing gas tank 7 are removable so as to allow their replacement when they are empty. The portable unit 3 may for example include one or several fastening strap(s) 8 making it possible to removably fasten the combustible gas tank 6 and the oxidizing gas tank 7 on a support body 10 of the portable unit 3.

The oxidizing gas contained in the oxidizing gas tank 7 may for example be dioxygen, ozone, hydrogen peroxide, halogens, or any other oxidizing gas, and the combustible gas contained in the combustible gas tank 6 may for example be dihydrogen, methane, ethane, propane, butane, pentane, acetylene, or any other combustible gas.

The portable unit 3 further includes a combustible gas distribution circuit 9 which is fluidly connected to the combustible gas tank 6, and an oxidizing gas distribution circuit 11 which is fluidly connected to the oxidizing gas tank 7. Advantageously, the combustible gas distribution circuit 9 successively includes a first pressure regulator, a first solenoid valve and a first non-return valve, and the oxidizing gas distribution circuit 11 successively includes a second pressure regulator, a second solenoid valve and a non-return valve.

The portable unit 3 also includes a first connection fitting 12 which is fluidly connected to the combustible gas distribution circuit 9, and a second connection fitting 13 which is fluidly connected to the oxidizing gas distribution circuit 7.

Figure 2:
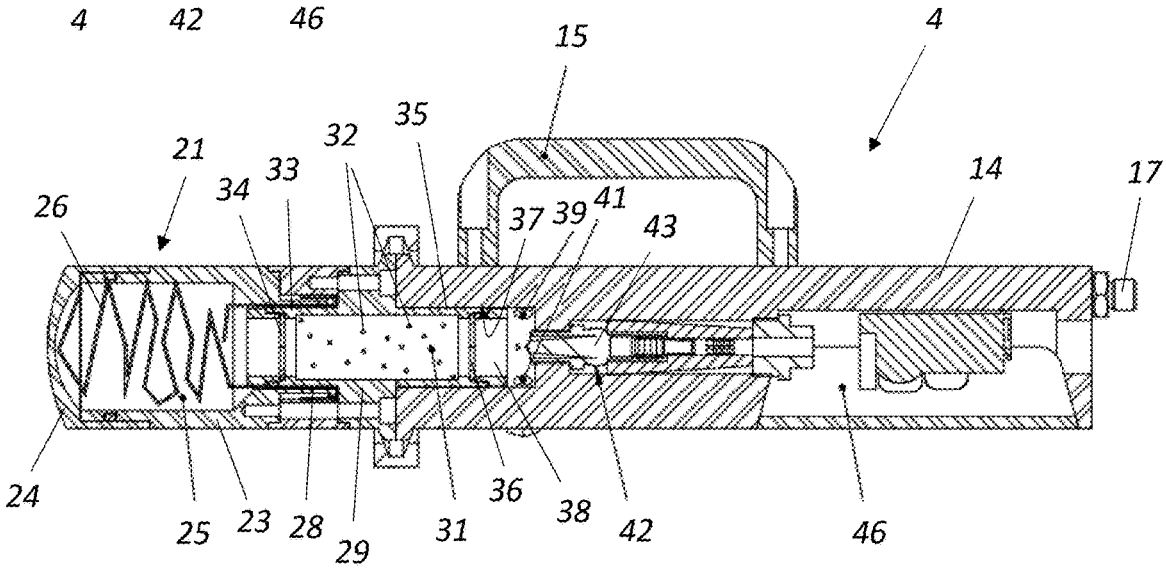
FIG. 2 is a longitudinal sectional view of an explosion unit of the avalanche triggering system of FIG. 1.
Figure 3:
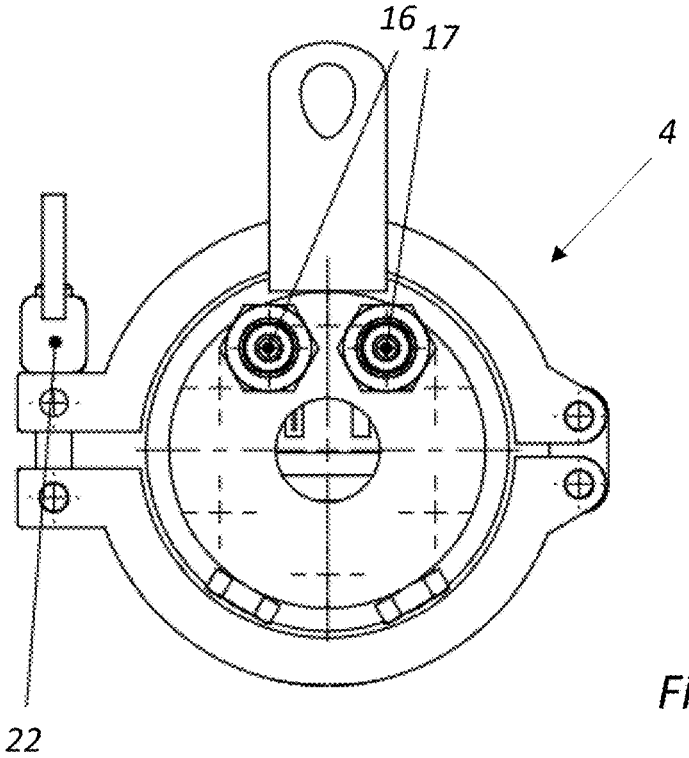
FIG. 3 is a front view of the explosion unit of the FIG. 2.
Figure 4:
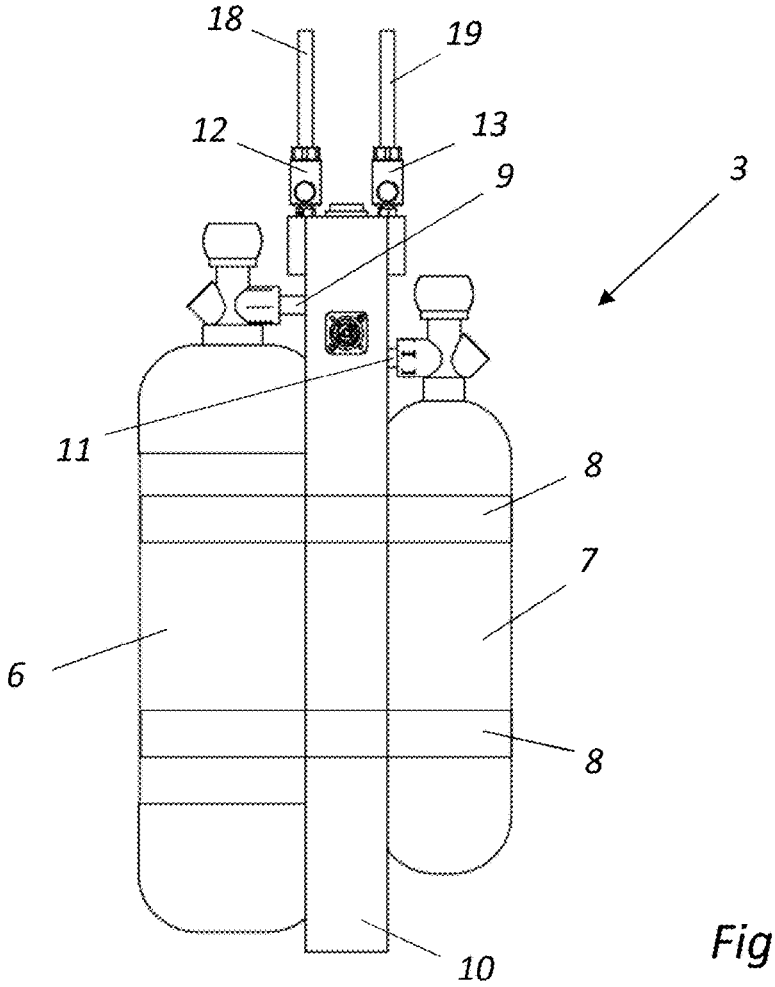
FIG. 4 is a side view of a portable unit of the avalanche triggering system of FIG. 1.

As shown in FIG. 2, the explosion unit 4 includes a support portion 14 equipped with a gripping handle 15. The support portion 14 includes a primary connection fitting 16 and a secondary connection fitting 17, and the avalanche triggering system includes a combustible gas supply conduit 18 which extends between the portable unit 3 and the explosion unit 4 and which fluidly connects the first connection fitting 12 to the primary connection fitting 16, and an oxidizing gas supply conduit 19 which extends between the portable unit 3 and the explosion unit 4 and which fluidly connects the second connection fitting 13 to the secondary connection fitting 17.

The explosion unit 4 further includes a removable cartridge 21 which is removably mounted on the support portion 14, for example using a fastening collar 22. The removable cartridge 21 includes in particular a cartridge casing 23 and a removable protective cover 24 which delimit a receiving housing 25.

The explosion unit 4 further includes a flexible envelope 26 which is housed in the receiving housing 25 and which is configured to be at least partially filled with an explosive gas mixture formed by combustible gas and oxidizing gas coming respectively from the combustible gas tank 6 and the oxidizing gas tank 7. The flexible envelope 26 includes an envelope chamber 27 configured to contain the explosive gas mixture, and a filling opening 28 opening into the envelope chamber 27.

More particularly, the flexible envelope 26 may be deformed between a rest configuration (see FIG. 2) in which the flexible envelope 26 has a first inner volume and an inflated configuration (see FIG. 1) in which the flexible envelope 26 has a second inner volume which is greater than the first inner volume and is at least partially filled with the explosive gas mixture. Advantageously, the removable protective cover 24 is configured to be ejected from the cartridge casing 23 by the flexible envelope 26 when the flexible envelope 26 is deformed into the inflated configuration, and the flexible envelope 26 is configured to extend at least partly outside the receiving housing 25 when the flexible envelope 26 is in the inflated configuration.

According to an embodiment of the invention, the flexible envelope 26 may for example be made of kraft paper and be accordion-folded when it is in the rest configuration. According to another embodiment of the invention, the flexible envelope 26 may for example be made of flexible plastic material and be formed by an inflatable ball.

The removable cartridge 21 further includes a dust storage portion 29 which delimits an inner housing 31 containing combustible dust 32. The combustible dust 32 may for example include dust of agricultural origin, such as starch dust, peanut dust, wood dust, cellulose dust, flour, cornstarch and sugar dust. The combustible dust 32 may also for example include metal dust, such as aluminum or magnesium dust, or chemical dust, such as acetylsalicylic acid dust, ascorbic acid dust and dust of 2,6-Di-tert-butylphenol. The combustible dust 32 may also include mineral dust, such as coal or talc dust, or plastic or rubber dust, such as polyacrylonitrile dust, polycarbonate dust, polyester dust, polyethylene dust, polypropylene dust, polystyrene dust and polyurethane dust.

According to the embodiment represented in the figures, the dust storage portion 29 includes a first tubular end portion 33 which is closed off by a frangible separation wall 34 and which is at least partially inserted into the flexible envelope 26, and a second tubular end portion 35 which is opposite to the first tubular end portion 33 and which is closed off by a frangible closure wall 36. The frangible separation wall 34 is configured to separate the receiving housing 25 and the inner housing 31, and more particularly to fluidly isolate the inner housing 31 of the envelope chamber 27 from the flexible envelope 26. Advantageously, the frangible separation wall 34 is formed by a frangible separation membrane, and the frangible closure wall 36 is formed by a frangible closure membrane.

According to the embodiment represented in the figures, the support portion 14 includes a bore 37 in which is removably mounted the second tubular end portion 35, and the second tubular end portion 35, the frangible closure wall 36 and the support portion 14 delimit an inner chamber 38. The explosion unit 4 advantageously includes a combustible gas supply circuit 39 which opens into the inner chamber 38 and which is fluidly connected to the combustible gas supply conduit 18 via the primary connection fitting 16, and an oxidizing gas supply circuit 41 which opens into the inner chamber 38 and which is fluidly connected to the oxidizing gas supply pipe 19 via the secondary connection fitting 17.

Advantageously, the frangible closure wall 36 is configured to be ruptured when the gas pressure in the inner chamber 38 exceeds a predetermined pressure, while the frangible separation wall 34 is configured to be ruptured when the gas pressure in the inner housing 31 exceeds a predetermined pressure value. In particular, when the explosion unit 4 is supplied with oxidizing gas and combustible gas coming from the gas storage device 5, the gas pressure in the inner chamber 38 rises until it causes the rupture of the frangible closure wall 36, then the gas pressure in the inner housing 31 rises until it causes the rupture of the frangible separation wall 34, which causes the projection of combustible dust 32 into the flexible envelope 26 and allows the filling of the flexible envelope 26 with the explosive gas mixture.

The explosion unit 4 further includes an ignition device 42 which is fastened to the support portion 14 and which is configured to trigger the explosion of the explosive gas mixture contained in the flexible envelope 26. According to the embodiment represented in the figures, the ignition device 42 includes a spark plug 43 which is configured to generate a spark adapted to cause combustion of the explosive gas mixture. Nonetheless, the spark plug 43 could be replaced by any other ignition device making it possible to cause the combustion of the explosive gas mixture.

The avalanche triggering system 2 further includes a control unit 44 which is configured to remotely control the ignition device 42, and in particular to control the generation of a spark when the ignition device includes the spark plug 43. The control unit 44 is also configured to control the opening and closing of the first and second solenoid valves belonging to the combustible gas distribution circuit 9 and to the oxidizing gas distribution circuit 11.

According to the embodiment represented in the figures, the control unit 44 is carried by the portable unit 3, and comprises a microprocessor adapted to develop control instructions. Advantageously, the portable unit 3 includes a control panel 45 equipped with a plurality of control buttons.

The avalanche triggering system 2 also includes a safety device including a transmitter 46 which is carried by the explosion unit 4, and a receiver 47 which is carried by the portable unit 3 and which is configured to communicate with the transmitter 46. The safety device further includes a processing unit 48 which is for example carried by the portable unit 3 and which is configured to calculate the separation distance separating the transmitter 46 from the receiver 47. The processing unit 48 is more particularly configured to prevent ignition of the ignition device 42 if the separation distance is less than the predetermined distance. The safety device may for example be an avalanche victim search device, also called Avalanche Victim Detector (AVD). According to an embodiment of the invention, the control unit 44 and the processing unit 48 may be formed by the same microprocessor.

The presence of such a safety device makes it possible to avoid any triggering of an explosion of the explosive gas mixture if the operator is not located at a minimum distance from the explosion unit, and therefore to greatly limit the risks of injury to the operator.

The avalanche triggering system 2 further includes an electrical energy storage device 49, such as a rechargeable battery, which is disposed in the portable unit 3 and which is configured to electrically power the portable unit 49 and the ignition device 42.

The avalanche triggering system 2 also includes a power supply cable 51 which electrically connects the ignition device 42 to the portable unit 3.

Advantageously, the avalanche triggering system 2 includes a connecting cable which extends between the portable unit 3 and the explosion unit 4 and which contains the combustible gas supply conduit 18, the oxidizing gas supply conduit 19 and the power supply cable 51.

The operation of the avalanche triggering system 2 according to the present invention will now be described.

When an operator wishes to trigger a preventive avalanche, he throws the explosion unit 4, using the grip handle 15, at the precise location where he wants to trigger the avalanche, he actuates a control button of the control panel 45 so that the control unit 44 controls the opening, for a predetermined time period, of the first and second solenoid valves of the combustible gas distribution circuit 9 and of the oxidizing gas distribution circuit 11. The supply of the explosion unit 4 with the combustible gas and the oxidizing gas successively causes the rupture of the frangible separation wall 36, the rupture of the frangible closure wall 34, the projection of combustible dust 32 into the flexible casing 26 and the filling of the flexible envelope 26 with an explosive gas mixture. When the desired explosive gas mixture is reached, the operator actuates a control button on the control panel 45 so that the control unit 44 controls the ignition device 42 to trigger the explosion of the explosive gas mixture. The shock wave generated by the explosion is transmitted to the snowpack, and makes it possible to detach the snow and to trigger a preventive avalanche.

According to a variant of the avalanche triggering system 2, the explosion unit 4 could be configured to be connected to a drone and to be transported by such a drone. According to such a variant, the explosion unit 4 could be provided, instead of the gripping handle 15 or in addition to the gripping handle 15, with a fastening member provided on the support portion 14 and configured to removably fasten the support portion 14 to the drone.

Thus, when an operator wishes to trigger a preventive avalanche using such an avalanche triggering system 2, he attaches the explosion unit 4 to the drone and controls a displacement of the drone to the precise location where the avalanche is to be triggered, then he actuates a control button on the control panel 45 so that the control unit 44 controls the opening, for a predetermined time period, of the first and second solenoid valves of the combustible gas distribution circuit 9 and the oxidizing gas distribution circuit 11, so as to fill the flexible envelope 26 with an explosive gas mixture.

When the desired explosive gas mixture is reached, the operator actuates a control button on the control panel 45 so that the control unit 44 controls the ignition device 42 to trigger the explosion of the explosive gas mixture.

Nonetheless, the operator could also control the filling of the flexible envelope 26 with an explosive gas mixture before fastening the explosion unit 4 to the drone and controlling a displacement of the drone to the precise location where the avalanche is to be triggered.

It goes without saying that the invention is not limited to the sole embodiment of this avalanche triggering system, described above as example, but in the contrary, it encompasses all the variants.

The invention claimed is:

1. An avalanche triggering system including:

a portable unit configured to be carried by an operator, the portable unit comprising a gas storage device configured to store an oxidizing gas and a combustible gas, an explosion unit which is configured to be launched by the operator and which is fluidly connected to the portable unit, the explosion unit including a flexible envelope which is configured to be at least partially filled with an explosive gas mixture formed by combustible gas and oxidizing gas coming from the gas storage device, the flexible envelope being deformable between a rest configuration in which the flexible envelope has a first inner volume and an inflated configuration in which the flexible envelope has a second inner volume which is greater than the first inner volume and is at least partially filled with the explosive gas mixture, the explosion unit further comprising an ignition device which is configured to trigger the explosion of the explosive gas mixture contained in the flexible envelope, and a control unit which is configured to remotely control the ignition device.

2. The avalanche triggering system according to claim 1, wherein the gas storage device includes a combustible gas tank and an oxidizing gas tank.

3. The avalanche triggering system according to claim 2, wherein the combustible gas tank and the oxidizing gas tank are removable.

4. The avalanche triggering system according to claim 3, in which the portable unit includes a combustible gas distribution circuit which is fluidly connected to the combustible gas tank, and an oxidizing gas distribution circuit which is fluidly connected to the oxidizing gas tank.

5. The avalanche triggering system according to claim 4, which includes a combustible gas supply conduit which extends between the portable unit and the explosion unit and which is configured to fluidly connect the combustible gas distribution circuit to the flexible envelope, and an oxidizing gas supply conduit which extends between the portable unit and the explosion unit and which is configured to fluidly connect the oxidizing gas distribution circuit to the flexible envelope.

6. The avalanche triggering system according to claim 5, which further includes a safety device which is configured to prevent ignition of the ignition device if a separation distance separating the explosion unit from the portable unit is less than a predetermined value.

7. The avalanche triggering system according to claim 6, wherein the safety device includes a transmitter which is carried by one of the portable unit and the explosion unit, a receiver which is carried by the other of the portable unit and the explosion unit and which is configured to communicate with the transmitter, the safety device being configured to calculate the separation distance separating the transmitter from the receiver and to prevent an ignition of the ignition device if the separation distance is less than the predetermined value.

8. The avalanche triggering system according to claim 7, wherein the explosion unit includes combustible dust which is configured to be received in the flexible envelope.

9. The avalanche triggering system according to claim 8, wherein the explosion unit includes an inner housing containing the combustible dust, the explosion unit being configured such that the combustible dust is projected into the flexible envelope by the oxidizing gas and the combustible gas coming from the gas storage device when the flexible envelope is at least partially filled with the explosive gas mixture.

10. The avalanche triggering system according to claim 2, in which the portable unit includes a combustible gas distribution circuit which is fluidly connected to the combustible gas tank, and an oxidizing gas distribution circuit which is fluidly connected to the oxidizing gas tank.

11. The avalanche triggering system according to claim 10, which includes a combustible gas supply conduit which extends between the portable unit and the explosion unit and which is configured to fluidly connect the combustible gas distribution circuit to the flexible envelope, and an oxidizing gas supply conduit which extends between the portable unit and the explosion unit and which is configured to fluidly connect the oxidizing gas distribution circuit to the flexible envelope.

12. The avalanche triggering system according to claim 1, which further includes a safety device which is configured to prevent ignition of the ignition device if a separation distance separating the explosion unit from the portable unit is less than a predetermined value.

13. The avalanche triggering system according to claim 12, wherein the safety device includes a transmitter which is carried by one of the portable unit and the explosion unit, a receiver which is carried by the other of the portable unit and the explosion unit and which is configured to communicate with the transmitter, the safety device being configured to calculate the separation distance separating the transmitter from the receiver and to prevent an ignition of the ignition device if the separation distance is less than the predetermined value.

14. The avalanche triggering system according to claim 1, wherein the explosion unit includes combustible dust which is configured to be received in the flexible envelope.

15. The avalanche triggering system according to claim 14, wherein the explosion unit includes an inner housing containing the combustible dust, the explosion unit being configured such that the combustible dust is projected into the flexible envelope by the oxidizing gas and the combustible gas coming from the gas storage device when the flexible envelope is at least partially filled with the explosive gas mixture.

16. The avalanche triggering system according to claim 1, wherein the explosion unit includes a removable cartridge including a receiving housing in which is housed the flexible envelope.

17. The avalanche triggering system according to claim 16, wherein the removable cartridge includes a cartridge casing and a removable protective cover which at least partially delimit the receiving housing, the removable protective cover being configured to be ejected from the cartridge casing by the flexible envelope when the flexible envelope is deformed into the inflated configuration.

18. The avalanche triggering system according to claim 1, wherein the control unit is carried by the portable unit.

19. The avalanche triggering system according to claim 1, wherein the portable unit includes an electrical energy storage device configured to electrically power the portable unit and the ignition device.

20. The avalanche triggering system according to claim 1, which includes a power supply cable which electrically connects the ignition device to the portable unit.

* * * * *